US011517485B2

(12) United States Patent
Saxon et al.

(10) Patent No.: US 11,517,485 B2
(45) Date of Patent: Dec. 6, 2022

(54) APPARATUS FOR VICTIM EXTRICATION, TRANSPORT, AND METHOD OF USE

(71) Applicant: RescueX, LLC, Denver, CO (US)

(72) Inventors: Brian Saxon, Denver, CO (US); Scott Noble, Denver, CO (US)

(73) Assignee: RFX, LLC, Denver, CO (US)

( * ) Notice: Subject to any disclaimer, the term of this patent is extended or adjusted under 35 U.S.C. 154(b) by 0 days.

(21) Appl. No.: 17/122,101

(22) Filed: Dec. 15, 2020

(65) Prior Publication Data

US 2021/0093492 A1 Apr. 1, 2021

Related U.S. Application Data

(63) Continuation-in-part of application No. 16/390,868, filed on Apr. 22, 2019, now Pat. No. 11,058,592.

(60) Provisional application No. 62/728,417, filed on Sep. 7, 2018, provisional application No. 62/660,799, filed on Apr. 20, 2018.

(51) Int. Cl.

| | |
|---|---|
| ***A61G 1/013*** | (2006.01) |
| ***A61G 1/044*** | (2006.01) |
| ***A61G 1/02*** | (2006.01) |

(52) U.S. Cl.

CPC ..... *A61G 1/013* (2013.01); *A61G 1/02* (2013.01); *A61G 1/044* (2013.01)

(58) Field of Classification Search

CPC . A61G 1/00; A61G 1/013; A61G 1/02; A61G 1/0206; A61G 1/0212; A61G 1/0225; A61G 1/0231; A61G 1/025

See application file for complete search history.

(56) References Cited

U.S. PATENT DOCUMENTS

| | | | | |
|---|---|---|---|---|
| 3,449,776 | A * | 6/1969 | Brock | A61G 1/013 5/628 |
| 4,485,504 | A | 12/1984 | Lehmann | |
| 5,179,746 | A * | 1/1993 | Rogers | A61G 1/0231 5/628 |
| 7,530,126 | B2 * | 5/2009 | Thompson | A61G 1/00 128/870 |
| 7,549,661 | B2 * | 6/2009 | Jackson | B62K 27/02 280/491.1 |
| 7,891,697 | B1 * | 2/2011 | Fahrbach | B62D 63/061 280/789 |
| 8,936,253 | B1 * | 1/2015 | Rizzi | A61G 1/042 5/628 |

(Continued)

OTHER PUBLICATIONS

American Heart Association/American Stroke Association; Fact Sheet: Systems of Care for Acute Cardiovascular Conditions; pp. 1-3; Jul. 2013; www.heart.org/policyfactsheets.

(Continued)

*Primary Examiner* — Peter M. Cuomo
*Assistant Examiner* — George Sun
(74) *Attorney, Agent, or Firm* — Voz Patents, LLC

(57) ABSTRACT

The present invention is directed to an apparatus resembling a rescue backboard for the extrication of individuals in scenarios wherein the individual requires attention, such as medical attention. In particular, the invention surrounds an apparatus and method providing a board which permits folding for increased stowage, and directional arrest features which assist in extricating a victim from a water-borne environment by preventing the victim from sliding back into the water after partial extrication.

18 Claims, 13 Drawing Sheets

(56) References Cited

U.S. PATENT DOCUMENTS

2003/0200972 A1* 10/2003 Crutchfield ..... A61G 1/04 5/601
2006/0085910 A1* 4/2006 Walkingshaw ..... A61G 1/017 5/81.1 R
2006/0195987 A1* 9/2006 Walkingshaw ..... A61G 1/02 280/5.24
2007/0157390 A1* 7/2007 Molinaro ..... A61G 1/013 5/658
2009/0260159 A1* 10/2009 Buchanan ..... A61G 7/0507 5/617
2009/0276959 A1* 11/2009 Menna ..... A61G 1/013 5/611
2010/0122416 A1* 5/2010 Bandel ..... A61G 1/056 5/626
2011/0177733 A1* 7/2011 Grimes ..... A61G 1/02 441/80
2011/0185504 A1* 8/2011 Kenalty ..... A61G 1/044 280/30
2012/0007340 A1* 1/2012 Bar Noy ..... A61G 1/0275 280/640
2012/0151679 A1* 6/2012 Kenalty ..... A61G 1/013 5/628
2012/0180218 A1 7/2012 Augustijn et al.
2013/0015629 A1* 1/2013 Bengtzen ..... A45C 9/00 280/30
2014/0083347 A1* 3/2014 Taylor ..... B63B 35/38 114/263
2017/0112692 A1 4/2017 Arimura et al.
2017/0246059 A1* 8/2017 Chinn ..... F16M 13/02
2018/0000665 A1* 1/2018 Piccolo-Wignall .... A61G 1/044

OTHER PUBLICATIONS

Aug. 14, 2020 Non-Final Office Action issued in U.S. Appl. No. 16/390,868.
Junkin Folding Plastic Backboard, Live Action Safety, 3 pages [Retrieved from the internet Nov. 9, 2020; https://www.liveactionsafety.com/junkin-folding-plastic-backboard-without-pins/?gclid=Cj0KCQiA7qP9BRCLARIsABDaZzhfoIMUHU6bEHjKiuGVrHLLcL_kwV%E2%80%A6.
Tablu Tri-Fold Backboard, Ferno; 5 pages; https://fernoems.com/ferno/media/us/products/product-tablu-tri-fold-backboard-blue-folded.png?ext=.png.
Ultra Space Save; Iron Duck; 6 pages [retrieved from the internet Nov. 9, 2020; https://ironduck.com/product/ultra-space-save-3/.

* cited by examiner

DETAIL C

APPARATUS FOR VICTIM EXTRICATION, TRANSPORT, AND METHOD OF USE

CROSS REFERENCE TO REFERENCE TO RELATED APPLICATIONS

This application is a Continuation In-Part of U.S. patent application Ser. No. 16/390,868 entitled "APPARATUS FOR VICTIM EXTRICATION, TRANSPORT, AND METHOD OF USE" filed on Apr. 22, 2019, which claims the benefit of U.S. Provisional Patent Application 62/660,799 entitled "APPARATUS FOR VICTIM EXTRICATION, TRANSPORT, AND METHOD OF USE" filed on Apr. 20, 2018; and U.S. Provisional Patent Application 62/728,417 entitled "APPARATUS FOR VICTIM EXTRICATION, TRANSPORT, AND METHOD OF USE" filed on Sep. 7, 2018—the entire contents of which are incorporated herein by reference in its entirety for all purposes.

FIELD OF THE INVENTION

The present invention is directed to a folding apparatus resembling a rescue backboard for the extrication of individuals in scenarios wherein the individual requires attention, such as medical attention. In particular, embodiments surround an apparatus and method for the extrication of an individual requiring medical attention from a water-borne environment.

BACKGROUND OF THE INVENTION

Preparing an individual for movement, transportation, or continuing medical attention is often coordinated with the stabilization of a victim prior to movement. Stabilizing a victim ensures that the victim can be attended to and moved, without unduly further injuring the individual when doing so. It will be appreciated that the term "victim" as used herein, refers to an individual requiring attention, particularly medical attention. A victim may require medical attention due to a variety of reasons. Events which result in a victim requiring medical attention include, but are not limited to, any medical condition that renders a person immobile or unconscious including, but not limited to—myocardial infarction, seizure, stroke, diabetic issue or any other medical reason.

Providing immediate medical attention to a victim has been directly correlated to the effectiveness and timeliness of the attention provided by a rescuer such as a first aider, a first responder or other medical professional. It will be appreciated that a first aider, as referred to herein, is an individual who provides assistance to a victim, with care provided to preserve life, prevent a condition from worsening, or to promote recovery. It will be further appreciated that a first responder, as referred to herein, refers to a person with specialized training who is among the first to arrive and provide assistance at the scene of an emergency surrounding at least one victim. For instance, the American Heart Association has published statistics relating to victims suffering from a sudden cardiac arrest with witnessed ventricular fibrillation. In such scenarios, if CPR (cardiopulmonary resuscitation) and defibrillation are administered between 3-5 minutes of collapse, this can result in a survival rate of greater than 50% for the victim. (Facts, When Minutes Matter: Systems of Care for Acute Cardiovascular Conditions [online]. American Heart Association, 013 [retrieved on 2018-04-17]. Retrieved from the Internet: <URL: https:// www.heart.org/idc/groups/heart-public/@wcm/@adv/documents/downloadable/ucm_304794.pdf>.)

SUMMARY OF THE INVENTION

The present invention is directed toward a folding apparatus and method for the extrication of a victim from a water-borne environment prior to and during the rescue process during which attention such as CPR, and other medical attention can be provided.

Existing solutions include the use of what is commonly referred to as a backboard or a spineboard. A backboard, typically approximately 182.9 cm (72 inches) in length, is designed to provide rigid support during movement of a person with suspected spinal or limb injuries. They are most commonly used by first responders such as ambulance staff, as well as lifeguards and ski patrollers.

A common shortcoming of a standard backboards of the prior art surrounds the size of the backboard. Although beneficial in certain scenarios for the carrying of a victim from a recovery location to a treatment location, the size of such backboards is limiting in areas where access is limited. Transporting a victim commonly requires 4 persons capable of walking and carrying a portion of the full weight of the victim for transportation of the victim. The carrying of a victim on a standard backboard commonly requires egress allowing for the width of the backboard as well as those carrying it. Furthermore, commonly used backboards commonly measure approximately 182.9 cm (72 inches) inches or longer in length in order to fully support the victim and all extremities. As a result of this length, standard backboards are often cumbersome to navigate around corners and through tight quarters. Time associated with readjusting a victim to navigate tight quarters can be detrimental to the prognosis and survival of the victim.

It is an aspect of the present invention to allow a single person to transport a victim from a recovery location to treatment location without the assistance of additional personnel. It is a further aspect of the present invention to allow the navigation around corners and through narrow pathways while maintaining the victim in a consistent position. However, it will be appreciated that embodiments of the present invention may comprise a board having a length of less than 182.9 cm (72 inches), or greater than or equal to 182.9 cm (72 inches) while in keeping with the spirit and scope of the present invention.

Existing backboards typically comprise a solid plastic form, or a molded plastic form with hollow cavities throughout the entirety of the backboard. Where these embodiments of previously existing solutions fall short, involves the extrication of a victim from a water-borne environment. Backboards constructed from solid plastic are denser than water and are negatively buoyant, thus the backboard sinks and results in difficulty in securing the victim to the board in a water-borne environment prior to extrication causing delay in extricating. Furthermore, backboards which are negatively buoyant may pose a drowning risk to the victim once the victim is secured to such a backboard. Those backboards that have hollow cavities throughout the entirety of the backboard result in a highly buoyant backboard. A highly buoyant backboard is problematic when attempting to secure the victim to the board, as the board is difficult to control when disposed beneath the victim as it wants to come to the surface. In some situation, this can cause the victim to roll off the backboard which in turn causes delays in extrication and poses a further drowning risk to the victim.

It is an aspect of the present invention to provide an apparatus for water-extrication having a neutral or near-neutral buoyancy. A neutral, or near-neutral buoyancy allows rescuing personnel to position the board under a water-borne victim which allows the board to remain in place while personnel tethers the victim to the board. In certain environments, it will be appreciated that a density between 0.9 g/cm^3 and 1.1 g/cm^3 permits a neutral, or near-neutral buoyancy in view of the density of fresh-water 1.0 g//cm^3 and in view of the density of salt-water at 1.03 g/cm^3. It will be further appreciated that certain embodiments of a board as disclosed herein provide between 0 lbs and 5 lbs of positive buoyancy. In certain embodiments still, a board as disclosed herein provides 0.5 lbs of positive buoyancy.

Certain embodiments of the present invention provide limited buoyancy through buoyancy features. It is an aspect of the present invention to provide limited buoyancy configured to allow a board to remain underneath a victim while an individual affixes the victim to the board without raising the center of gravity of the victim. Such buoyancy features may be added, removed, or modified to adjust the buoyancy of the board for buoyancy requirements for water salinity levels, water temperature, and a victim's body density.

It is an aspect of the present invention to provide an apparatus directed toward the extrication of a victim from a water-borne environment while substantially decreasing the extrication time, therefore allowing first aiders and first responders to provide attention more rapidly.

Certain embodiments of the present invention surround the use of a board having a length of approximately 121.9 cm (48 inches) or less.

Certain embodiments of the present invention comprise rails which serve to assist in the extrication of a victim from locations such as water-borne environments. Rails also provide a standoff from the ground which more easily allows for an individual to dispose their hands within a carry handle.

In certain embodiments, a board further comprises limited buoyancy. It will be appreciated that although high buoyancy is not desired in water rescue scenarios, some buoyancy can be helpful. Limited buoyancy allows an individual providing attention to a victim to focus on the fixation of the board to the victim while the board remains in place under the victim due to the limited buoyancy.

In certain embodiments, it may be desired to affix a roller or wheels to assist in the transition of the victim from a recovery location to a treatment location. For instance, transporting a victim once extracted out of the water, to a location suited for providing medical attention.

Existing solutions comprising a backboard typically surround a unitary apparatus which are 72 inches long or longer. Where such solutions fall short is with storage. A backboard having a length of 72 inches or longer can be easily hung on a wall of a facility such as a swimming pool, but such solutions are often too large for space limited areas such as aboard small watercraft.

It is an aspect of certain embodiment of the present invention to provide a folding rescue board which folds to a fraction of its fully extended length. In exemplary embodiments of a folding board as discussed herein, the board comprises three nesting segments which are interconnected pivotally such that in an extended configuration, the rescue board measures 43 inches, which in a stowed configuration measures 18 inches.

Certain existing solutions provide a spine-board having three segments wherein a user is able to pivotally fold the spine-board into a fraction of the size. Where such existing solutions fall short surrounds the failure to allow the locking of segments into place when in an extended or stowed configuration. Thus, such spine-boards can allow the flexion or extension of a victim's spine when it is of critical importance to stabilize the victim's spine and restrict movement of the spine.

Aspects of the present invention provide pivot locks configured to constrain segments in an extended or stowed configuration thereby preventing the extension and flexion of a victim's spine.

Where existing spine-boards fall short in use for extricating a victim from water environments surrounds the step of pulling a victim from the water. In a scenario wherein a rescuer is smaller in stature than the victim, particularly in the scenario involving a single rescuer, extricating the victim from a pool or onto a boat can prove difficult as the victim must be able to essentially lift the victim from the water over the length of at least half the length of the victim's body in order to extricate them over the sidewall of a pool or onto the deck of a boat.

Certain embodiments comprise directional arrest feature wherein the progress of extricating a victim out of a body of water is retained by allowing the sliding of the board along an edge such as an edge of a pool, or the edge of a boat in a superior direction but arrests the sliding of the board in an inferior direction. Such directional arrest features allow a rescuer to make progress in the extrication of a victim, but allows the rescuer to rest periodically without losing the progress made. In certain embodiments, the directional arrest features comprise notches which allow the rails to slide in a superior direction, pulling the second end of the board away from the water. However, if a rescuer stops pulling, allowing the board rails to slide in an inferior direction—once a notch is engaged on the structure, the notch prevents the board from sliding toward the water.

Existing spine-boards further fall short in the aspect of extricating a victim from the water in the event there is a single rescuer. Although a rescuer typically must be in the water to tether a victim to a spine-board, the rescuer must exit the water prior to extricating the victim. In the process of exiting the water the victim is left unattended, which may result in the victim overturning or submerging in the water—further complicating the victim's prognosis and reducing survival rate.

It is an aspect of the present invention to include a hook feature on a first side of the board which allows a rescuer to hook the first side of the board to a pool wall, boat platform or other structure prior to exiting the water. The victim is supported by the structure, maintaining the victim's head above water and allows the rescuer to exit the water without potential for the victim submerging or overturning, and thus maintaining the prognosis and survival rate.

These and other advantages will be apparent from the disclosure of the inventions contained herein. The above-described embodiments, objectives, and configurations are neither complete nor exhaustive. As will be appreciated, other embodiments of the invention are possible using, alone or in combination, one or more of the features set forth above or described in detail below. Further, this Summary is neither intended nor should it be construed as being representative of the full extent and scope of the present invention. The present invention is set forth in various levels of detail in this Summary, as well as in the attached drawings and the detailed description below, and no limitation as to the scope of the present invention is intended to either the inclusion or non-inclusion of elements, components, etc. in this Summary. Additional aspects of the present invention will become more readily apparent from the detailed description, particularly when taken together with the drawings, and the claims provided herein.

DETAILED DESCRIPTION OF VARIOUS EMBODIMENTS

Figure 1:
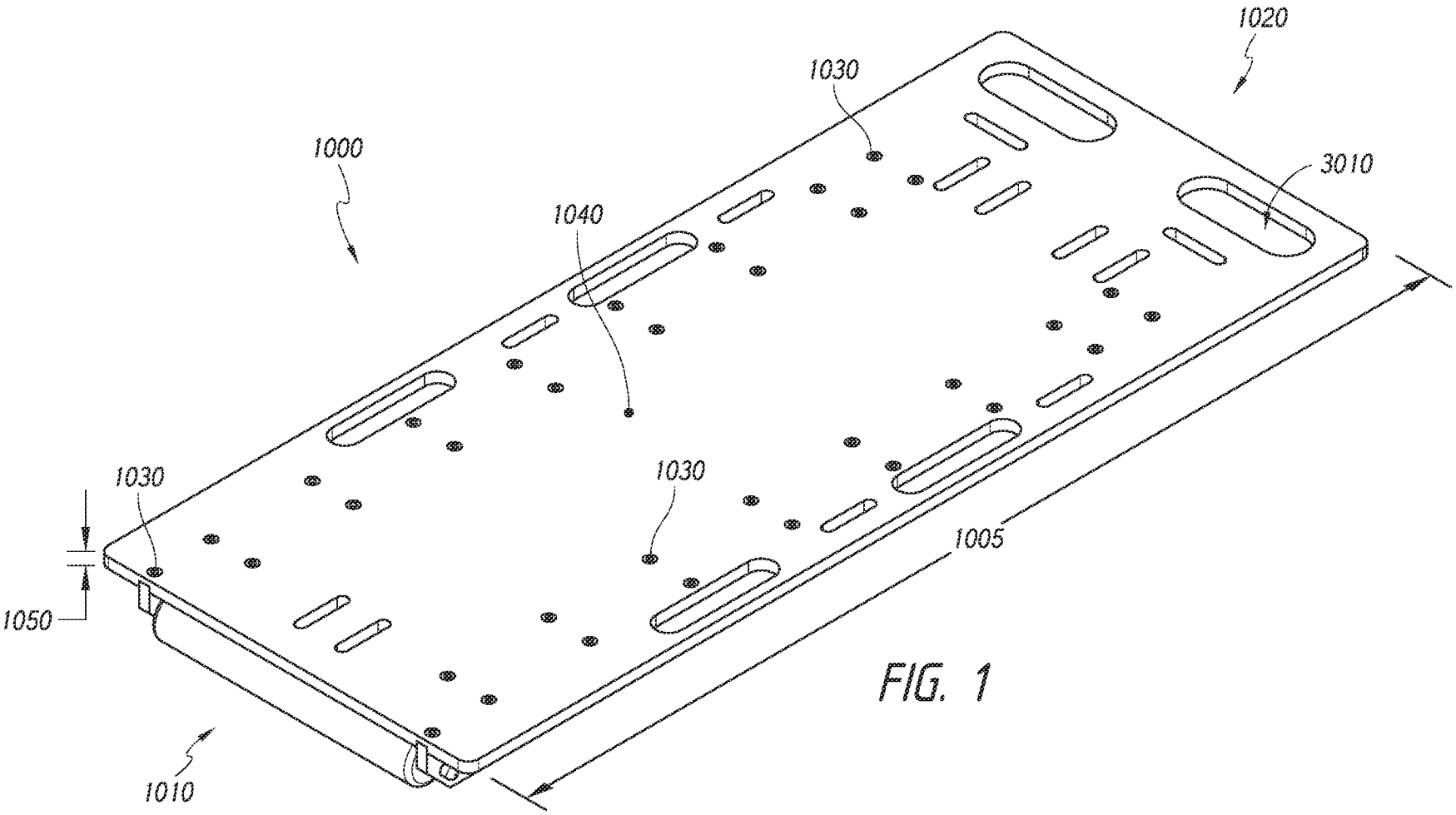
FIG. 1—A top perspective view of certain embodiments
Figure 2:
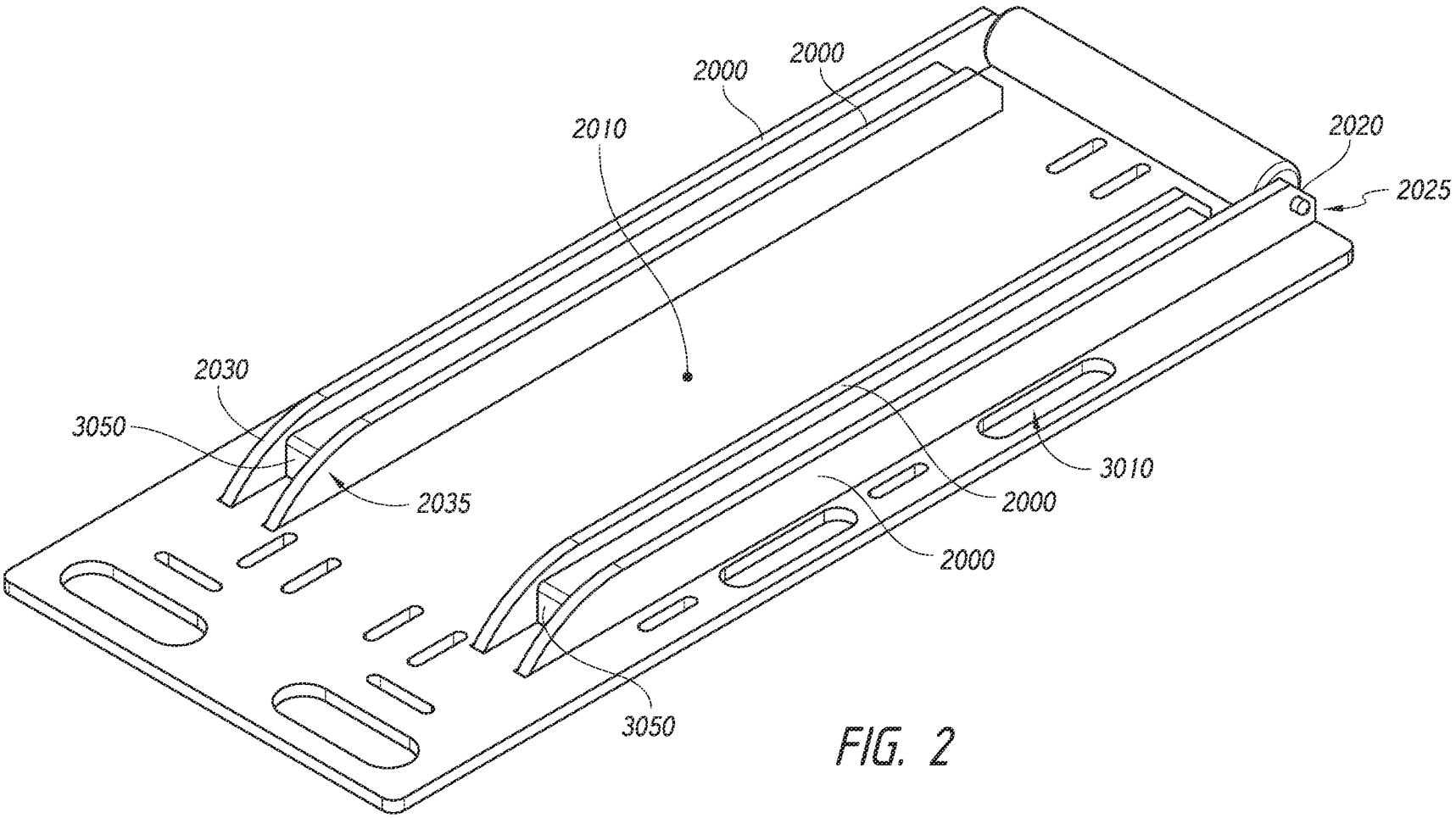
FIG. 2—A bottom perspective view of certain embodiments

Certain embodiments of the present invention, as seen in FIG. 1-FIG. 2, comprise a board 1000, having an oblong shape. In certain embodiments, it is desired that the board have a length 1005 configured to support a victim's head, back and buttocks. By supporting these regions of a victim, a rescuer is able to secure a victim for transport to a location suitable for victim treatment. In certain embodiments, it is further desired for the board 1000 to terminate inferior to a victim's buttocks. In such embodiments, it will be appreciated that a board 1000 having a length 1005 of 121.9 cm (48 inches) or less is sufficient to support the majority of victims from their head to their buttocks.

Certain embodiments, as seen in FIG. 1-FIG. 2, comprise a first rail 2000 and a second rail 2000 which protrude from a first surface 2010 of the board. The rails 2000 extend from a first end 1010 of the board, toward a second end 1020 of the board. Certain embodiments comprise rails 2000 which are affixed to the first surface 2010 of the board utilizing fasteners 1030 which extend from a second surface 1040 of the board, through the thickness 1050 of the board, and protrude from the first surface 2010 of the board and into the rails 2000. Certain embodiments comprise rails 2000 having a chamfer 2020 at a first end 2025 of the rails, and a taper 2030 at a second end 2035 of the rails. The taper 2020 of the second end is configured to prevent catching on structures when pulling a victim from an environment such as a pool. In certain embodiments, the rails 2000 are affixed to the first surface 2010 of the board, and the victim is tethered to the second surface 1040 of the board.

In certain embodiments, such as shown in FIG. 3-FIG. 7, rails 2000 extending from the first surface 2010 of the board provide an offset 3000 from the ground allowing rescuers to access handles 3010 without expending effort to space the first side 2010 of the board in order to dispose their hands through the handles 3010. Although the board 1000 and rails 2000 may be constructed from rigid materials, semi-rigid materials, or flexible materials alike, it will be appreciated that the board 1000 and rails 2000 of certain embodiments comprise a rigid material to provide a stable and rigid platform for transportation of the victim. It will be further appreciated that a rigid platform is desirable for purposes of performing lifesaving procedures such as cardiopulmonary resuscitation (CPR) without requiring the removal of the victim from the board 1000.

Figure 3:
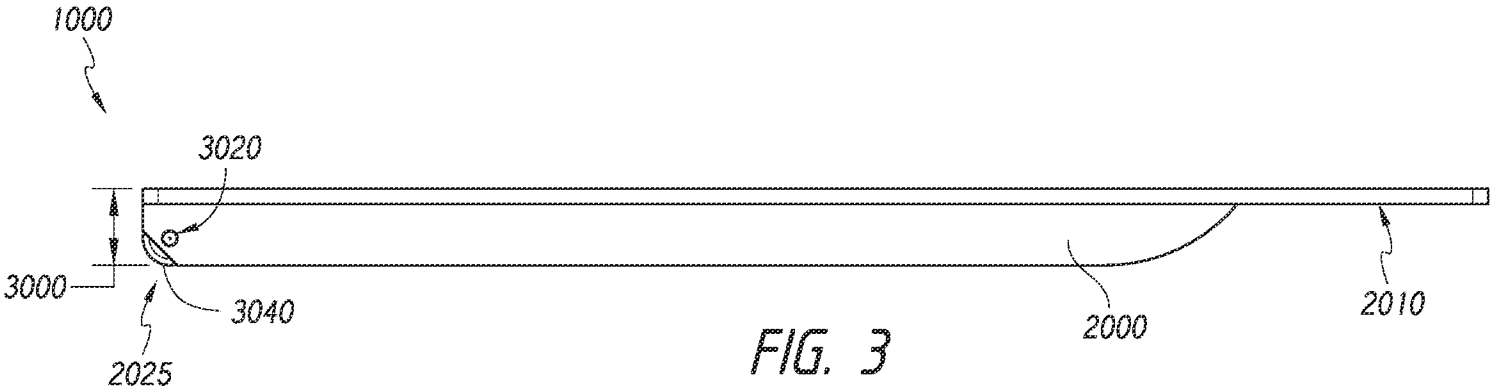
FIG. 3—A side view of certain embodiments
Figure 4:
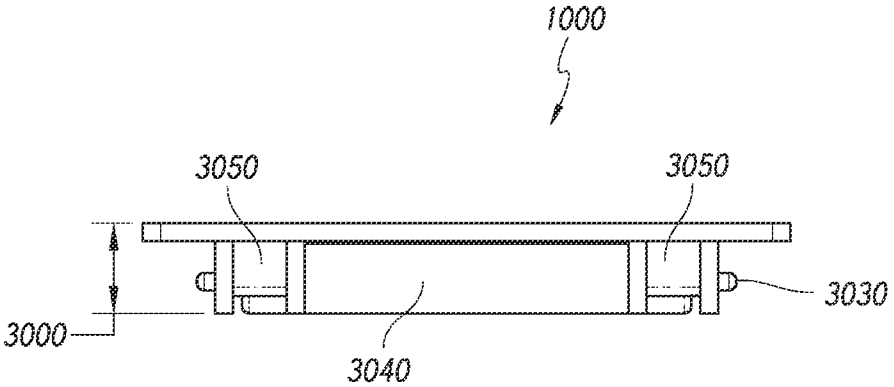
FIG. 4—A back view of certain embodiments
Figure 5:
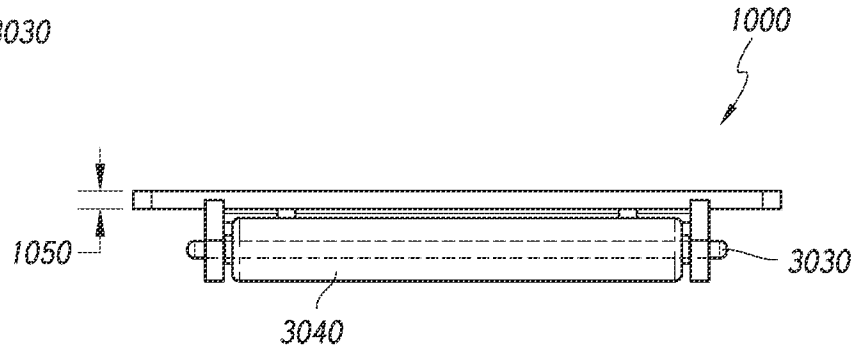
FIG. 5—A front view of certain embodiments
Figure 10A:
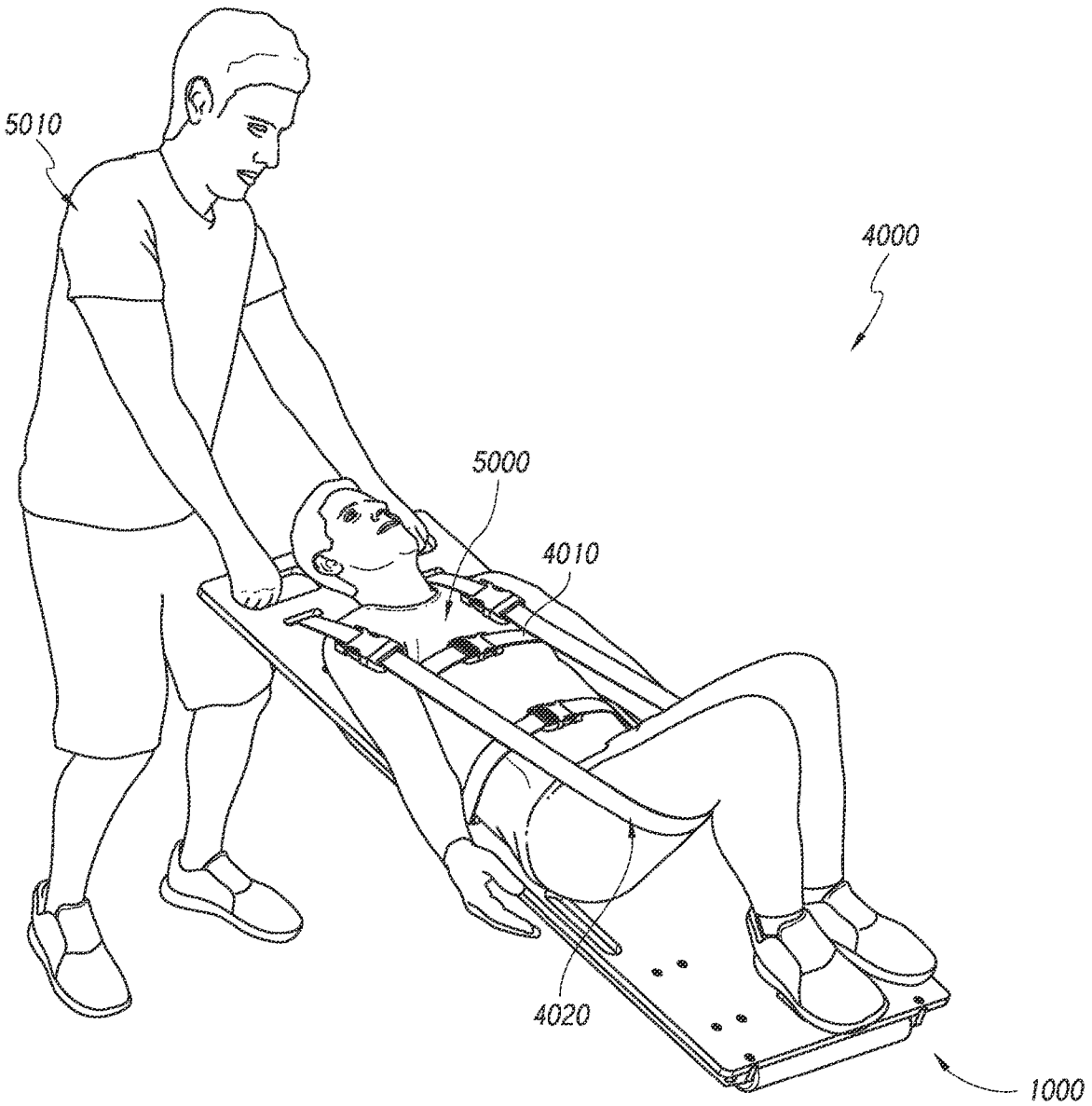
FIG. 10A—A perspective view of certain embodiments of the present invention in use for the transportation of a victim FIG. 10B—A perspective view of certain embodiments of the present invention in use for the transportation of a victim FIG. 11A—A top view of certain embodiments FIG. 11B—A bottom view of certain embodiments FIG. 12—A perspective view of certain embodiments comprising a folding board FIG. 13A—A perspective view of certain embodiments comprising a folding board in an extended configuration FIG. 13B—A perspective view of certain embodiments comprising a folding board in a stowed configuration FIG. 14A—A perspective view of certain embodiments comprising a folding board in a partially stowed configuration FIG. 14B—A side view of certain embodiments comprising a folding board in a partially stowed configuration FIG. 15A—A side view of certain embodiments comprising a folding board FIG. 15B—A detail view of certain embodiments of a directional arrest feature FIG. 15C—A detail view of certain embodiments of a directional arrest feature FIG. 16A—A bottom view of certain embodiments comprising a folding board FIG. 16B—A detail view of certain embodiments of a pivot lock

In certain embodiments, seen in FIG. 3-FIG. 5 for example, the first end 2025 of a first rail 2000 and a second rail 2000 further comprise a hole 3020 configured to receive an axle 3030 allowing the mounting of a roller 3040. A roller 3040 disposed over an axle 3030 element is configured to engage with the ground when the second end 1020 of a board is elevated above the first end 1010 of the board. Although the roller 3040 as shown comprises a cylindrical roller disposed between rails 2000, it will be appreciated that a roller 3040 may comprise an elongated roller, or a wheel to provide mechanical advantage to a rescuer when transporting a victim in a dragging configuration 4000 (FIG. 10A). By engaging the roller 3040 with the ground, an individual is able to more easily transport a victim—who is affixed to the board. In certain embodiments, the first end 2025 of the rails 2000 further comprise a chamfer 2020, bevel or other edge treatment allowing the engagement of the roller 3040 with the ground only when used in a dragging configuration 4000.

Figure 7:
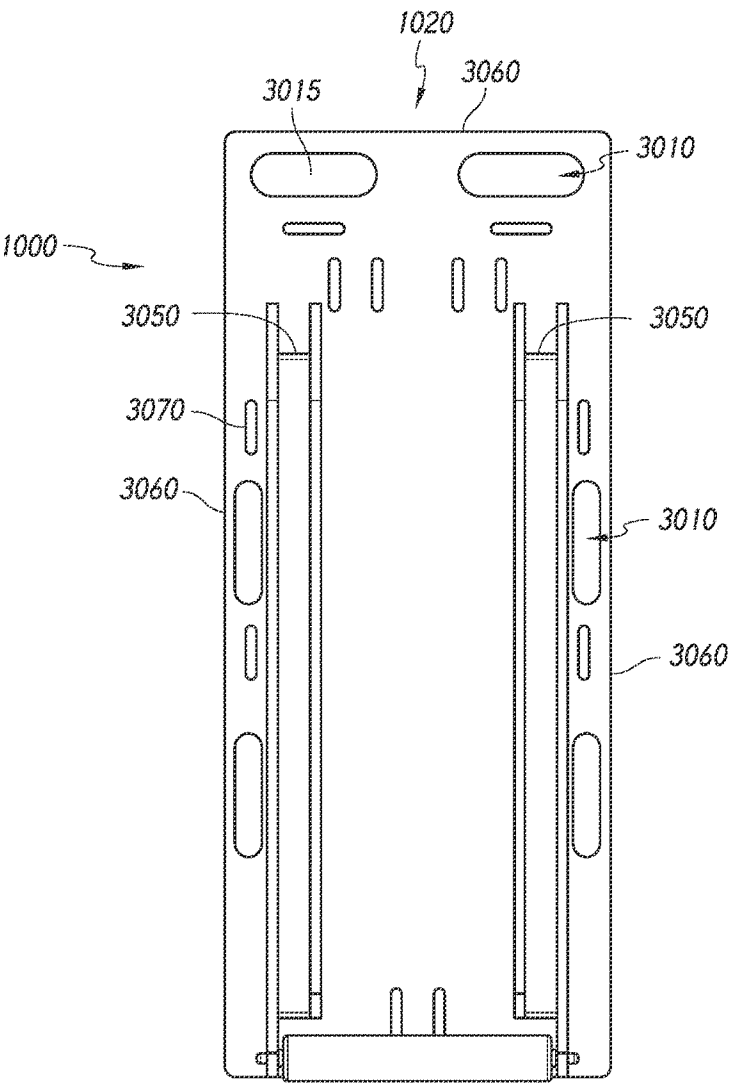
FIG. 7—A bottom view of certain embodiments

Certain embodiments—as shown in FIG. 2, FIG. 4, and FIG. 7—comprise a buoyancy feature 3050 configured to increase the buoyancy of a board. In certain embodiments, a buoyancy feature 3050 comprises materials having higher buoyancy than the board. It will be appreciated that a buoyancy feature 3050 may surround the use of a buoyant object or buoyant materials such as foam, enclosed air-bladders, captive air-pockets within the board, or other strategies for increasing buoyancy as appreciated by those skilled in the art. It will be appreciated that a buoyant material comprises a volumetric mass density less than the fluid it is placed in, such as water. Certain embodiments comprise buoyancy features 3050 constrained between a first rail 2000 and a second rail 2000. It will be appreciated that in certain embodiments it is desired that the buoyancy of the apparatus is configured such that the buoyancy force of the apparatus does not exceed the weight of a victim in a waterborne environment.

Certain embodiments comprising a board, further comprise handles 3010—as shown in FIG. 1, FIG. 2, FIG. 6 and FIG. 7. A handle 3010 of certain embodiments comprises an aperture 3015, oblong in shape and located proximal to an edge 3060 of the board. Furthermore, such handles 3010 are typically aligned having a length 3016 of the handle aligned with an edge 3060 of the board. Handles 3010 of certain embodiments are located proximal to a second end 1020 of the board to assist in the transport of a victim in a dragging configuration. Handles 3010 of some embodiments are proximal to a lateral edge 3060 of the board to assist in the transport of a victim when carrying the victim upon the board. Certain embodiments comprise two handles 3010 proximal to a second end 1020 of the board, two handles 3010 proximal to a first lateral edge 3060, and two handles 3010 proximal to a second lateral edge 3060 of the board.

Certain embodiments, such as shown in FIG. 6-FIG. 9, comprise tethering points 3070. It will be appreciated that for the purposes of the present invention, a tethering point 3070 surrounds a feature wherein a tether can be affixed. In certain embodiments, a tethering point 3070 comprises an aperture 3075 through a thickness 1050 (FIG. 5) of the board wherethrough a flexible length of strapping can be disposed to assist in the fixation of a victim to the board 1000, preferably in a manner to secure the victim to prevent further injury to the victim. In certain embodiments, as shown, the apertures 3075, comprise an elongated aperture.

Figure 10B:
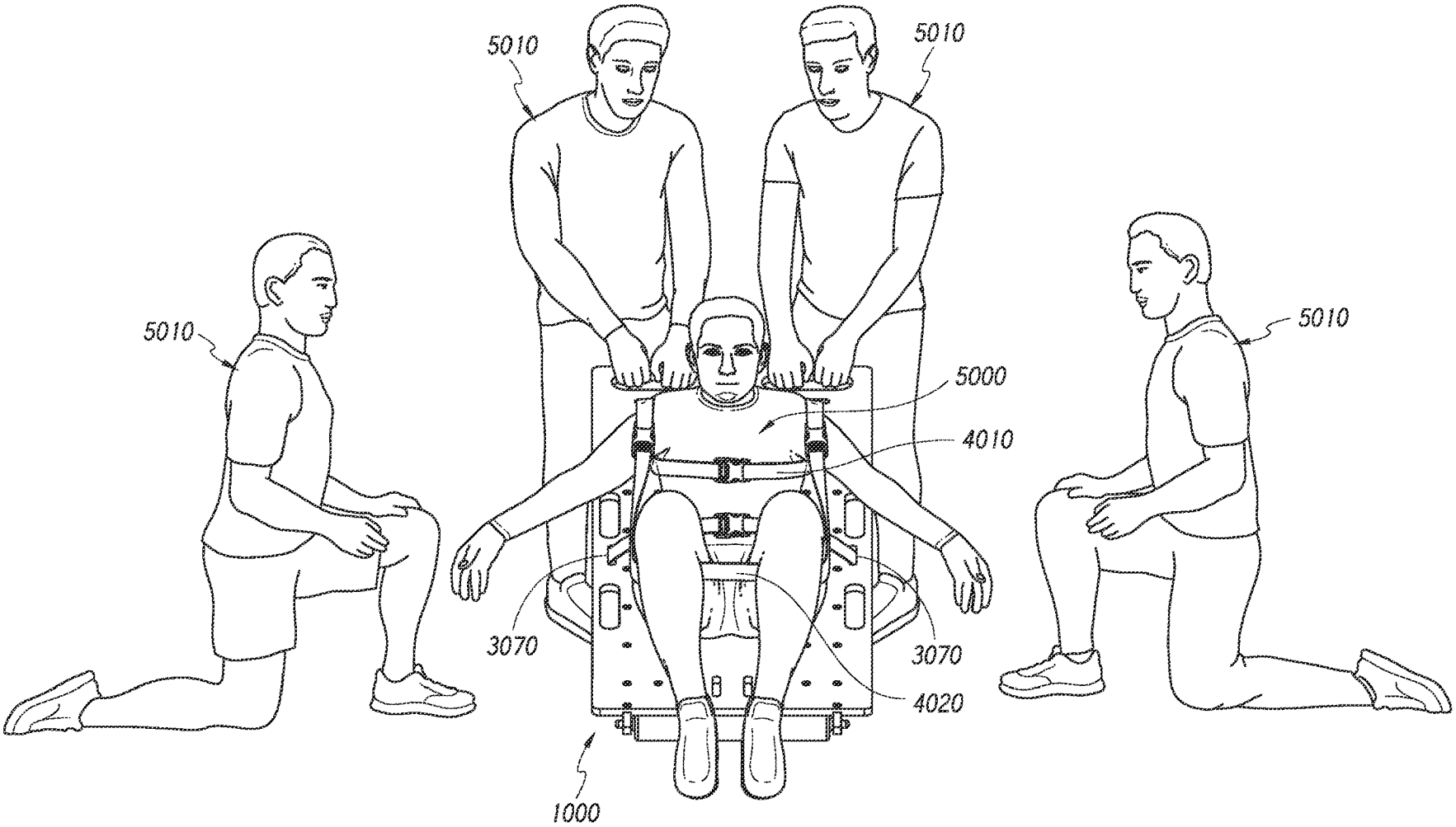

In certain embodiments, shown in FIG. 10A-FIG. 10B, a tether 4010 is configured to extend from a first tethering point 3070 adjacent to a first lateral edge 3060, to a second tethering point 3070 adjacent to a second lateral edge 3060, wherein the tether traverses a victim's torso therebetween.

Figure 6:
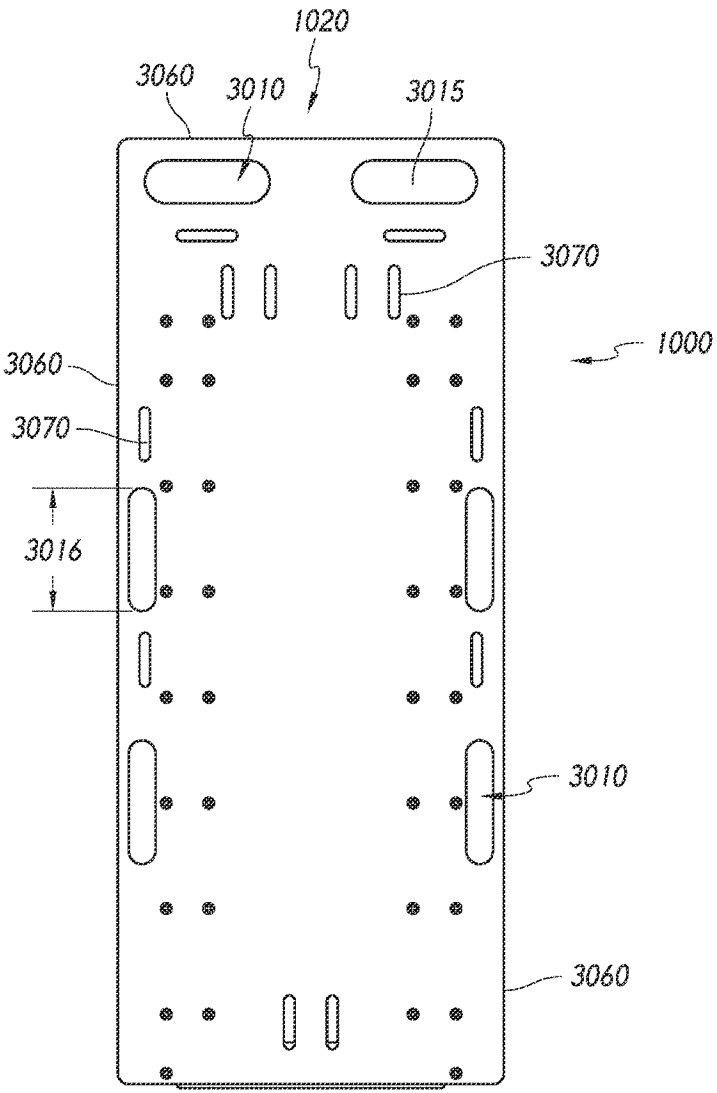
FIG. 6—A top view of certain embodiments
Figure 9:
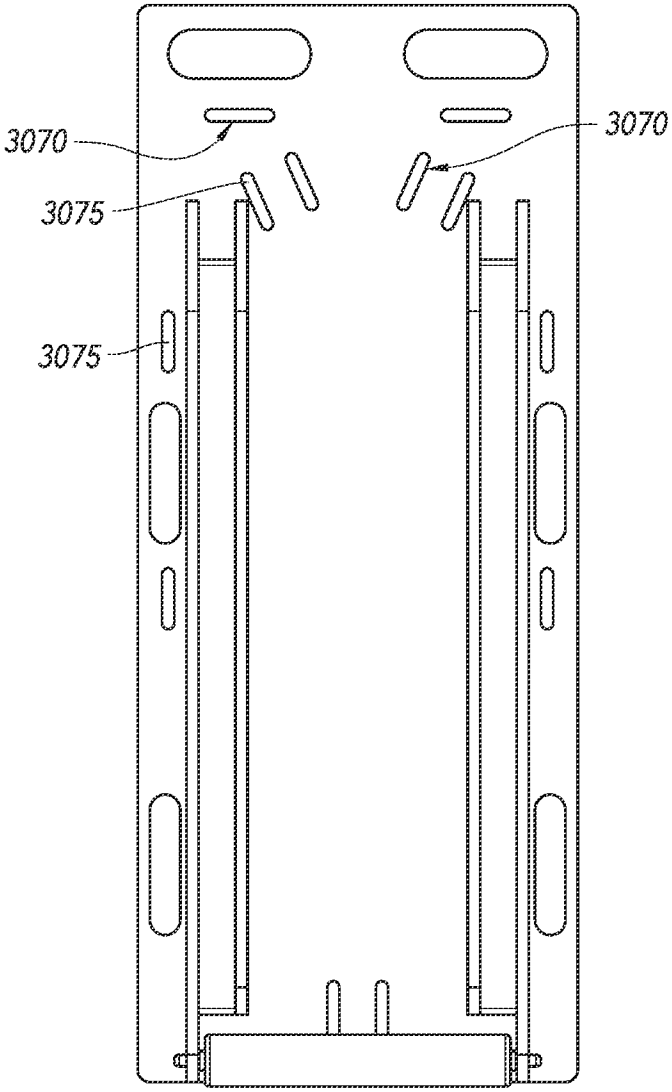
FIG. 9—A bottom view of certain embodiments
Figure 8:
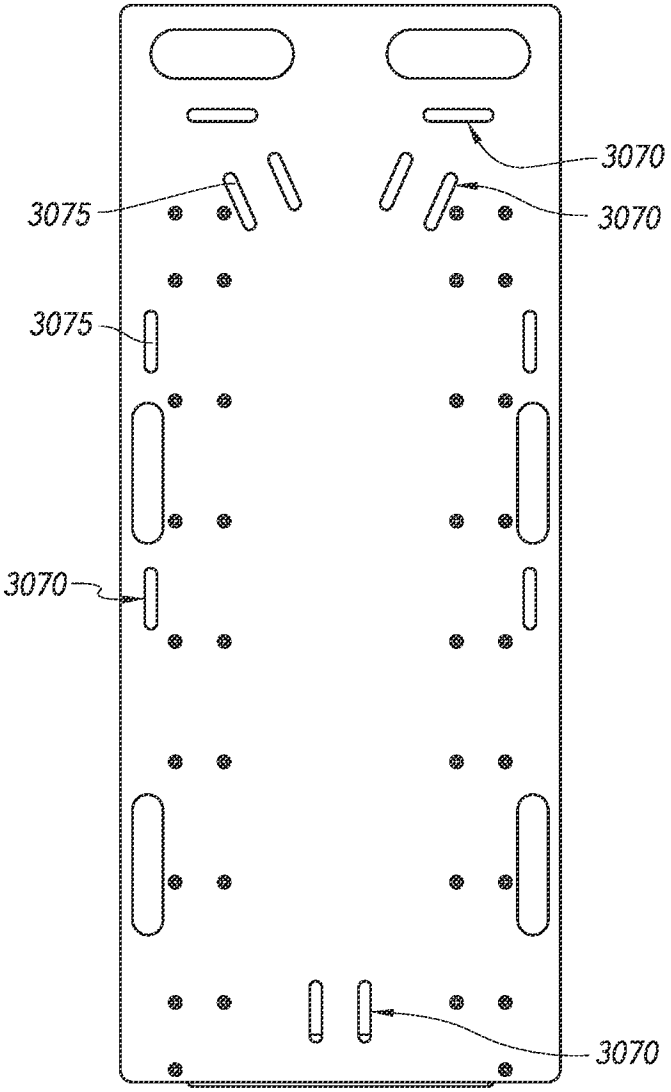
FIG. 8—A top view of certain embodiments

Certain embodiments, such as shown in FIG. 6-FIG. 7, comprise tethering points 3070 proximate to the first end 1010 of the board. Certain embodiments comprise tethering points proximate to the second end 1020 of the board. Certain embodiments comprise tethering points proximate to a lateral edge 3060 of the board.

The tethering points 3070 of certain embodiments, shown for example in FIG. 10A-FIG. 10B, are configured to allow multiple applications of tethers 4010 to a victim for increased fixation to the board. In certain embodiments, a first tether comprises a leg strap 4020 allows an individual to affix a victim in a configuration such that the victim's legs are held off the ground, allowing for increased mobility when transporting the victim—as seen in FIG. 10A-FIG. 10B. A leg strap 4020 allows the "bundling" of a victim 5000. The term "bundle", "bundled", or "bundling", as used herein, refers to preparing the victim 5000 in a manner to make their body more compact for ease of transport by rescuers 5010. In certain embodiments a victim's arms may be bundled to their torso so they do not impact objects during transport. A victim's legs impacting objects may result in further injury to the victim. Tethers 4010 having adjustable length, such as webbing or strapping, while affixed to the board 1000 are configured to be disposed behind the knees of the victim in order to bring the victim's thighs upward toward the victim's torso. By bundling a victim 5000, a rescuer 5010 can transport the victim in a more stable manner as the legs of the victim are contained rather than dragging when the board and victim are transported in a dragging configuration.

Certain embodiments comprise a tether 4010 configured as a chest strap 4030. A chest strap 4030 is configured to assist in affixing the victim 5000 to the board to secure the upper torso of the victim. Certain embodiments comprise a tether 4010 configured as a hip strap 4040. A hip strap 4040 is configured to assist in affixing the victim 5000 to the board to secure the lower torso of the victim.

Figure 11B:
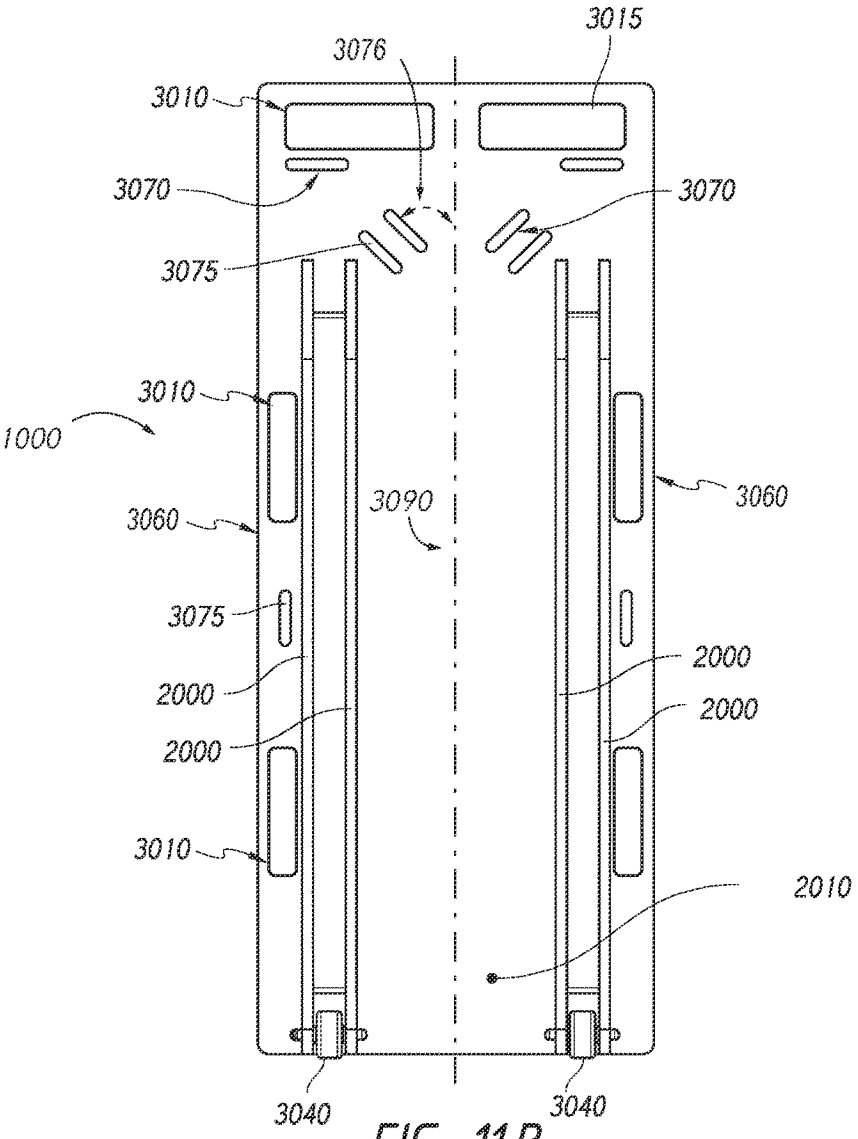
Figure 11A:
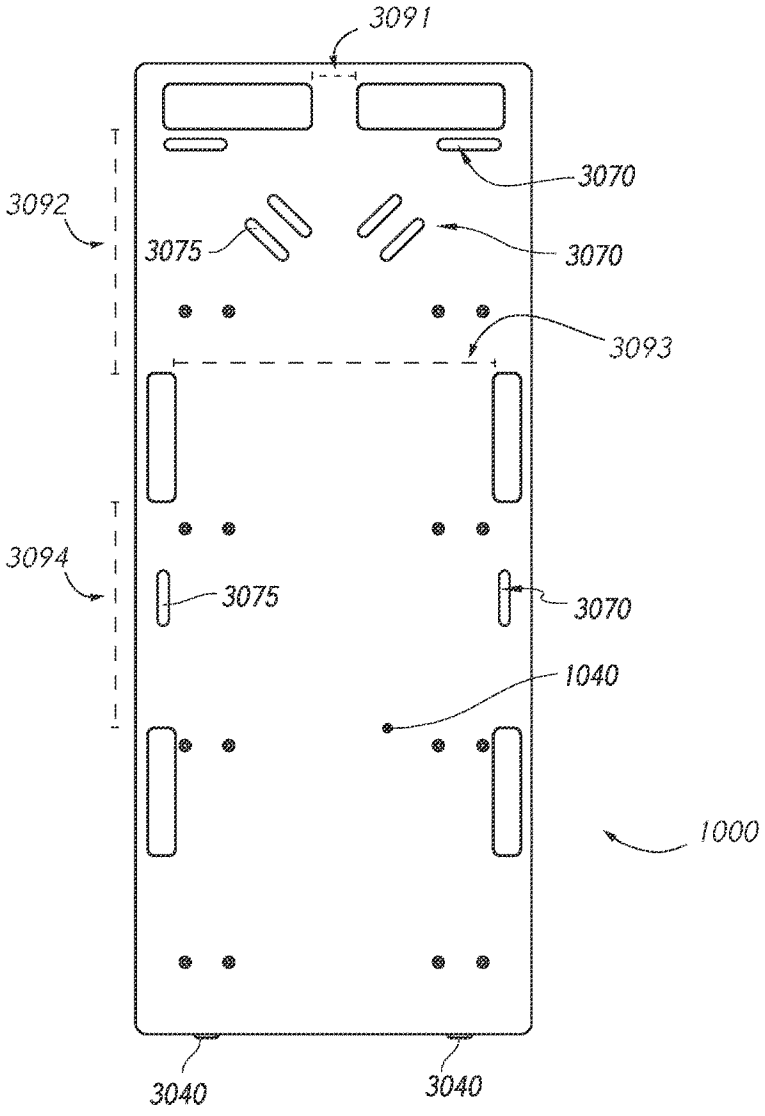

Certain embodiments, as shown in FIG. 11A-FIG. 11B, comprise a first roller 3040 affixed between a first rail 2000 and a second rail 2000. The roller 3040 of such embodiments comprises a wheel, such as shown in FIG. 11A-FIG. 11B. The first rail 2000 and the second rail 2000 comprise a hole 3020 configured to receive an axle 3030. The roller 3040, has a central hole therethrough configured to receive the axle 3030. Whereby, the roller 3030 is mounted to the axle 3030 and the axle affixed between the first rail 2000 and the second rail 2000. The roller 3040 is configured to engage with the ground when the second end 1020 of the board is elevated above the first end 1010 of the board. Certain embodiments comprise a first roller 3040, comprising a wheel, and a second roller 3040, comprising a wheel. The rollers 3040 of such embodiments allow for ease of pivoting while a victim is affixed to the board 1000.

Certain embodiments, shown in FIG. 11A-FIG. 11B, comprise a first tethering point 3070 offset from a longitudinal axis 3090 to a first side, and a second tethering point offset from a longitudinal axis 3090 to a second side. Tethering points can be used for affixing a chest strap 4030 configured to go under a victim's arms and over their chest, as a leg strap 4020 configured to go behind the knees for bundling, around a victim's waist, or other configurations as appreciated by one skilled in the art. In certain embodiments the tethering points 3070 comprise an aperture 3075.

In certain embodiments, such as shown in FIG. 11A-FIG. 11B, a first pair of handles located proximal to the second end of the board have a lateral offset 3091 between a first handle 3010 and a second handle 3010. The lateral offset 3091 of certain embodiments is approximately 5.1 cm (2 inches). Certain embodiments comprise a second pair of handles 3010 having a first handle 3010 proximal to a first lateral edge 3060 and a second handle 3010 proximal to a second lateral edge, and the first handle having a lateral offset 3093 from the second handle. The lateral offset 3093 of certain embodiments is 30.5 cm (12 inches). The second pair of handles have a longitudinal offset 3092 from the first pair of handles 3010. The longitudinal offset 3092 of certain embodiments is approximately 25.4 cm (10 inches). Certain embodiments comprise a third pair of handles 3010 having a first handle 3010 proximal to a first lateral edge 3060 and a second handle 3010 proximal to a second lateral edge, and the first handle having a lateral offset 3093 from the second handle. The third pair of handles 3010 have a longitudinal offset 3094 from the second pair of handles 3010. The longitudinal offset 3094 of certain embodiments is 33.0 cm (13 inches).

In certain embodiments, the tethering points 3070 comprise a first aperture 3075 and a second aperture 3075. In certain embodiments, such apertures configured to affix a tether for traversing under a victim's arm and over their chest. Certain embodiments of such tethering points 3075 have a lateral offset 3091 of 5.1 cm (2 inches).

It will be appreciated that the dimensions and offsets disclosed herein are not intended to be limiting to all embodiments. It will be appreciated that longitudinal offsets, lengths, and widths can be modified as desired while in keeping with the spirit and scope of the present invention.

In certain embodiments, as shown in FIG. 10A-FIG. 10B, a tether 4010 comprises a length of flexible tensile bearing material such as cordage, strapping, webbing or other tensile bearing material appreciated by those skilled in the art. In certain embodiments, the tether 4010 comprises an integral loop at a first end. The integral loop is configured to pass through a first aperture 3075 (FIG. 11A-FIG. 11B) of the board from the second surface of the board 1040 to the first surface 2010 of the board, a second end of the length of the tether 4010 is then passed through the integral loop, whereby the tether 4010 is affixed to the board 1000. In certain embodiments, shown in FIG. 11A-FIG. 11B, a board comprises a first aperture and a second aperture in near proximity to each other, such as apertures 3075 configured for disposed at an angle 3076. In such embodiments, a first end of a tether 4010 comprising an integral loop is passed through a first aperture 3075 from a second surface 1040, and then passed through the second aperture 3075 from the first surface 2010 back to the second surface 1040. A second end of the tether 4010 is then passed through the integral loop, thereby affixing the tether 4010 to the board. In certain embodiments a first tether 4010 comprises a first buckle 4015 at a second end, and a second tether 4010 comprising a second buckle 4105 second end, wherein the first buckle and is configured to affix to the second buckle.

Figure 12:
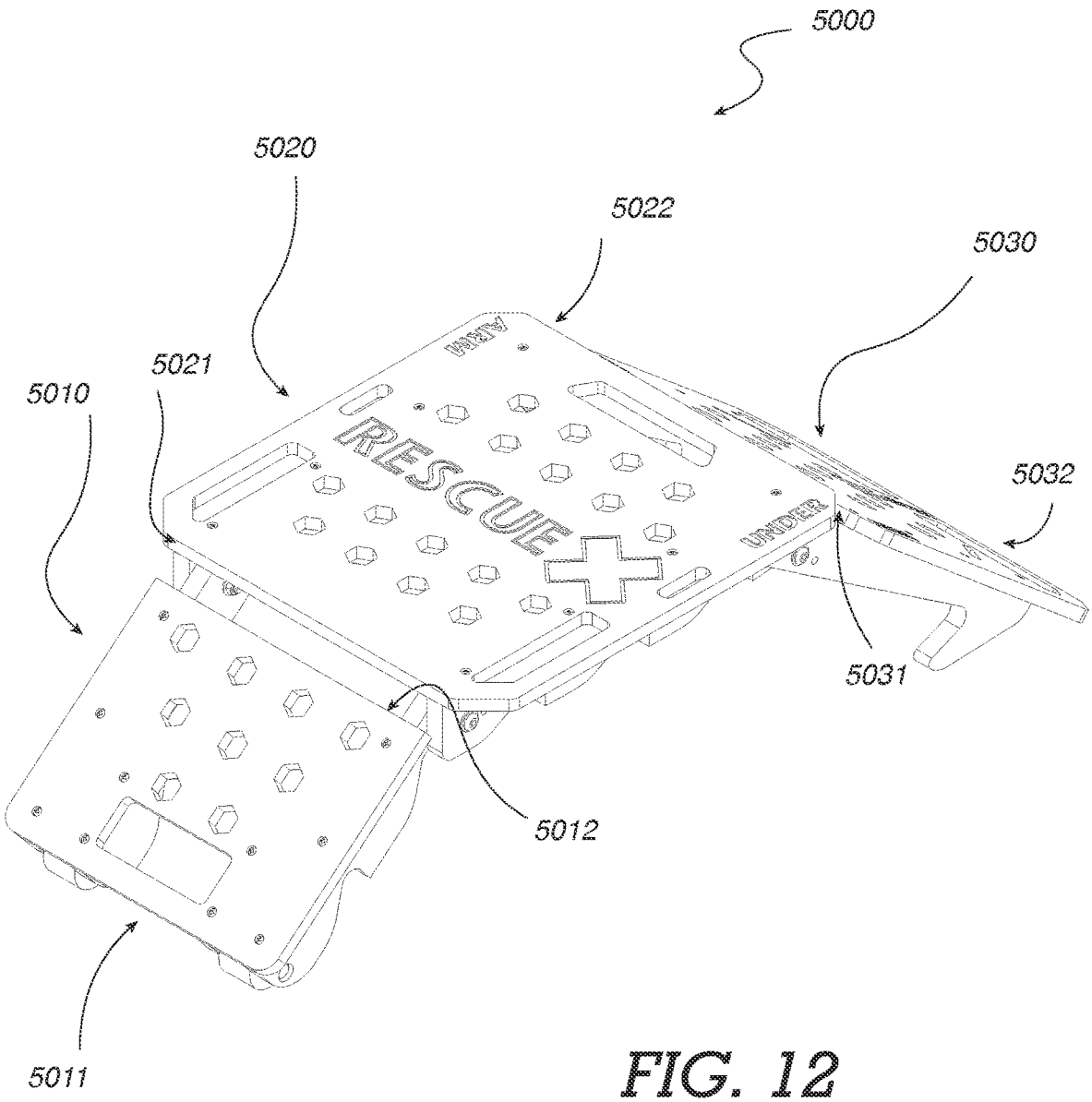
Figure 13A:
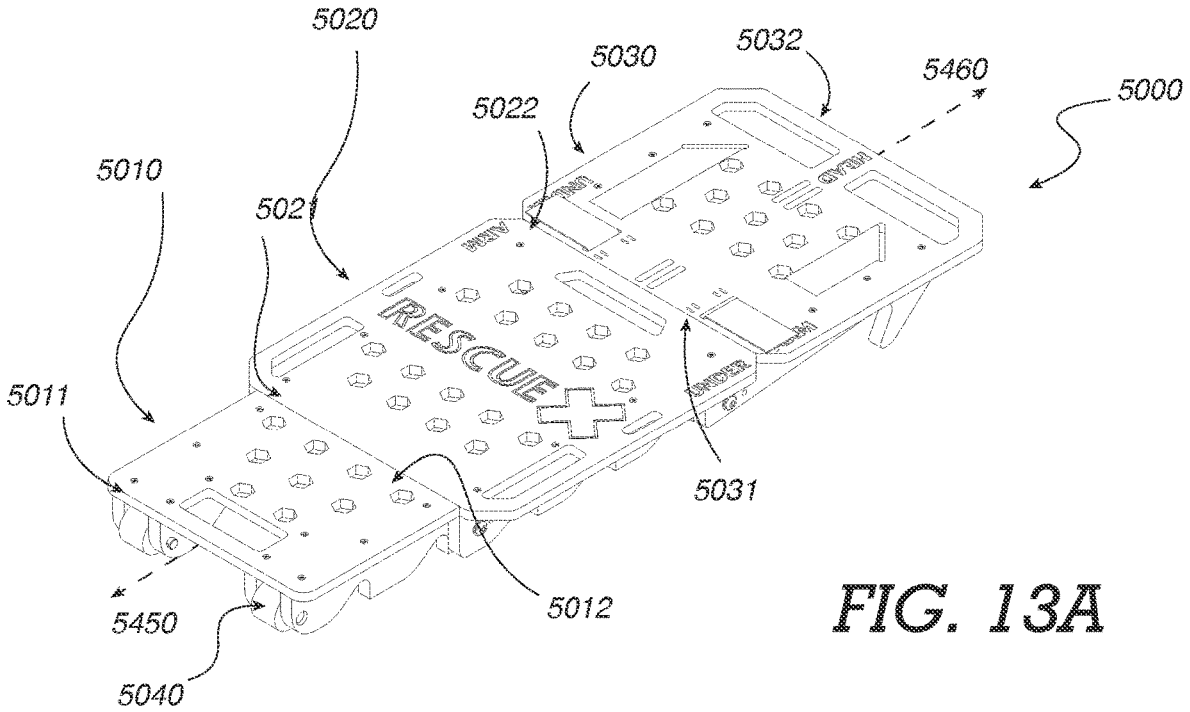
Figure 13B:
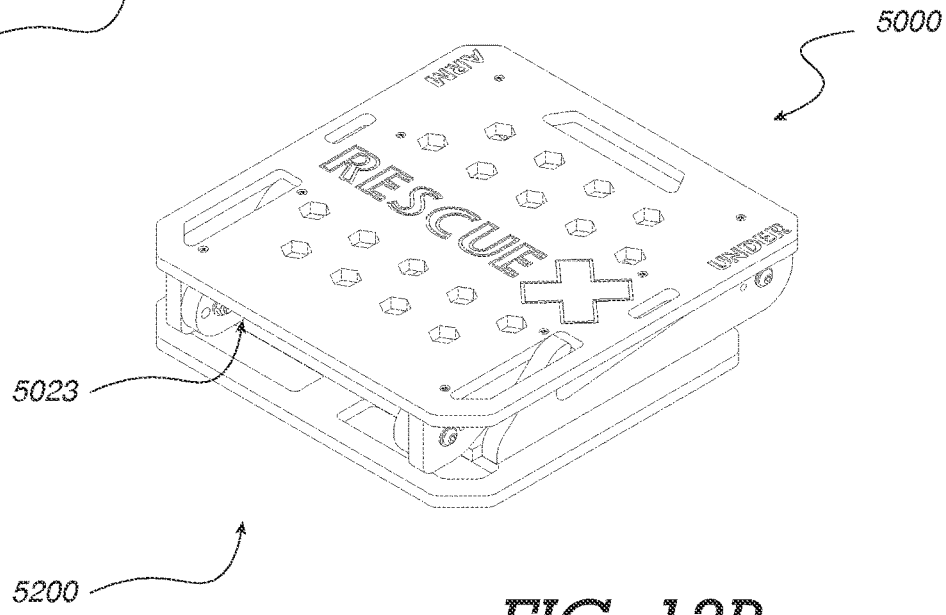
Figure 14A:
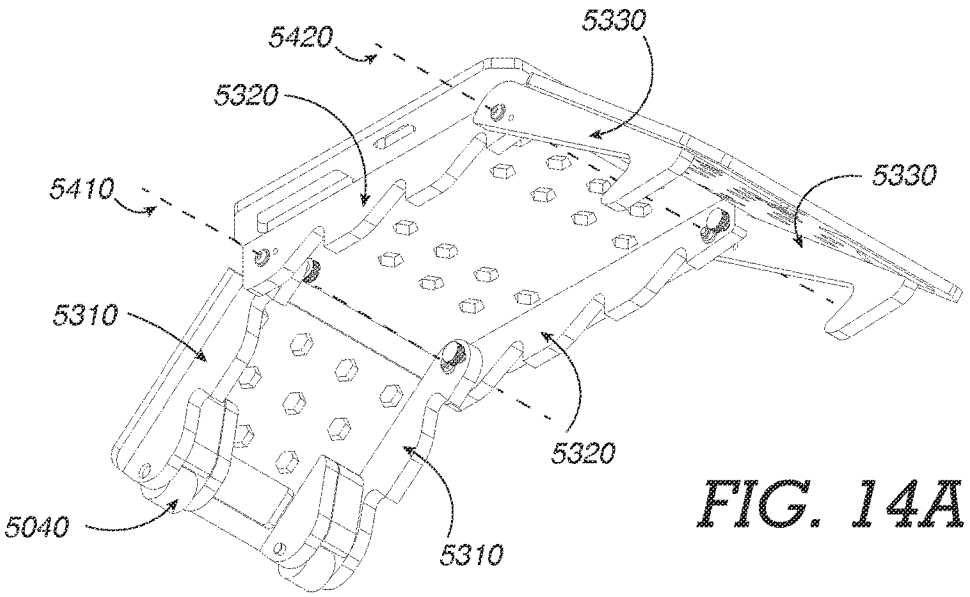
Figure 14B:
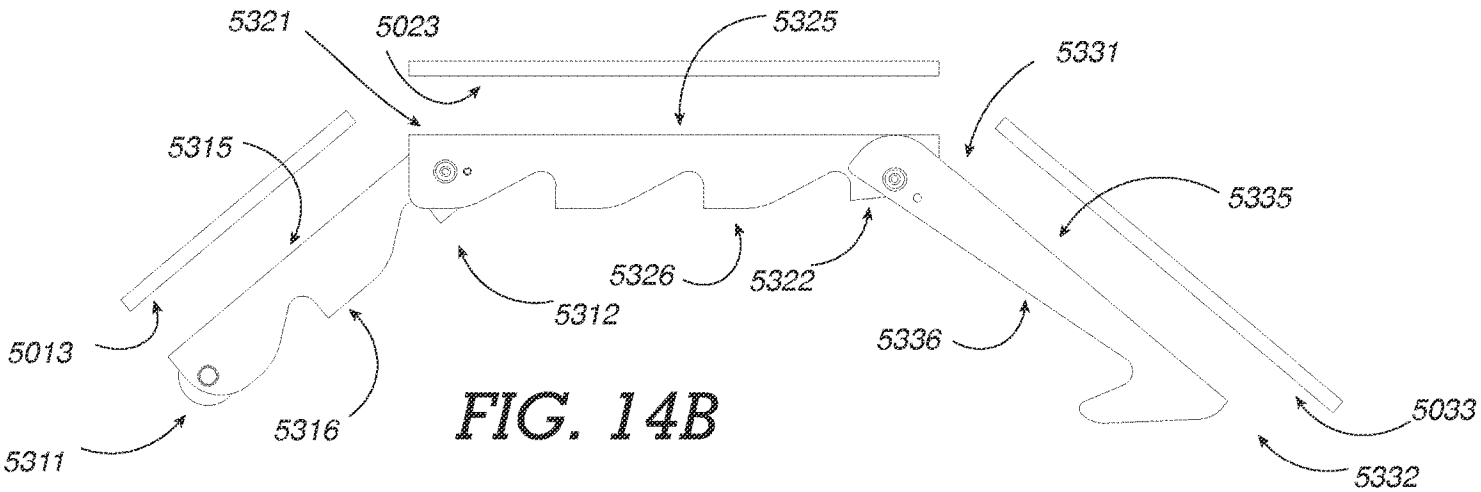

In certain embodiments, as shown in FIG. 12-FIG. 13B, a board 5000 comprises three segments (5010, 5020, 5030) wherein the segments are pivotally interconnected with each other to allow the folding and unfolding of the board between an extended configuration 5100 and a fully folded stowed 5200 configuration. The stowed configuration 5200 allows the stowage of the board 5000 when not in use. A first segment 5010 comprises rollers 5040 disposed at a first end 5011, and a second end 5012 of the first segment is pivotally interconnected with a first end 5021 of a second segment. A second end 5022 of the second segment is pivotally interconnected with a first end 5031 of a third segment, wherein the first segment 5010 and the third segment 5030 are pivotally foldable inward toward the second segment 5020. In certain embodiments, the first segment 5010 and the third segment 5030 are configured to nest adjacent a first side 5023 (See FIG. 14B) of the second segment as shown.

In certain embodiments, shown in FIG. 13A-FIG. 14B, the first segment 5010 comprises first rail and second rails 5310 affixed to a first side 5013 of the first segment, the second segment 5020 comprises first rail and second rails 5320 affixed to a first side 5023 of the second segment, and the third segment 5030 comprises first rail and second rails 5330 affixed to a first side 5033 of the third segment. The rails of each segment are laterally offset from each other, and in certain embodiments the rails of each segment are parallel to each other and are disposed adjacent to lateral aspects of each respective segment. In certain embodiments, the board comprises two rollers 5040 disposed between first ends 5311 of rails 5310 of the first segment.

In certain embodiments, the second ends 5312 of the rails of the first segment are pivotally interconnected with a first ends 5321 of the rails 5320 of the second segment along a first axis 5410, and the second ends 5322 of the rails 5320 of the second segment are pivotally interconnected with the first ends 5331 of the rails of the third segment along a second axis 5420. Therefore, the first segment 5010 is pivotally rotatable in relation to the second segment 5020 about the first axis 5410, allowing the first segment 5010 to stow adjacent to a first side 5023 of the second segment in a stowed configuration 5200, and extend away from the second segment 5020 in an inferior direction 5450 in an extended configuration 5100. Similarly, the third segment 5030 is pivotally rotatable in relation to the second segment 5020 about the second axis 5420 allowing the second segment 5020 to stow adjacent to the first side 5023 of the second segment in a stowed configuration 5200, and extend away from the second segment 5020 in a superior direction 5460 when in an extended configuration 5100.

In certain embodiments, shown in FIG. 14B-FIG. 15C, a board 5000 further comprises directional arrest features 5500 which permit the sliding of the board in the superior direction 5460, but do not allow the sliding of the board in the inferior direction 5450. With the rails 5310, 5320, 5330 affixed to the first side 5013, 5023, 5033 of the board segments with a first edge 5315, 5325, 5335 directed toward the first side of the board segments, the directional arrest features 5500 of certain embodiments are interconnected with a second edge 5316, 5326, 5336 of the rails wherein the directional arrest features 5500 are configured to allow a rescuer to slide the rails of the board along a structure—such as the edge of a pool or boat platform—in the superior direction 5460, but impede the sliding of the board 5000 in the inferior direction 5450. Although embodiments shown to comprise directional arrest features 5500 comprise segments which are pivotally interconnected, embodiments comprising a singular board segment, such as those shown in FIG. 1-FIG. 11B, having directional arrest features are within the spirit and scope of the present invention. In certain embodiments, the directional arrest features 5500 comprise notches 5505 in the first edges of the rails wherein a superior aspect 5510 of the notch is disposed at a first angle 5515 of 90-degrees or greater from the first side of the respective board segments measured from the superior direction 5460, while a second aspect of the notch is disposed at a second angle 5525 of less than 90-degrees from the first side of the respective board segments measured from the inferior direction 5450.

Figure 15A:
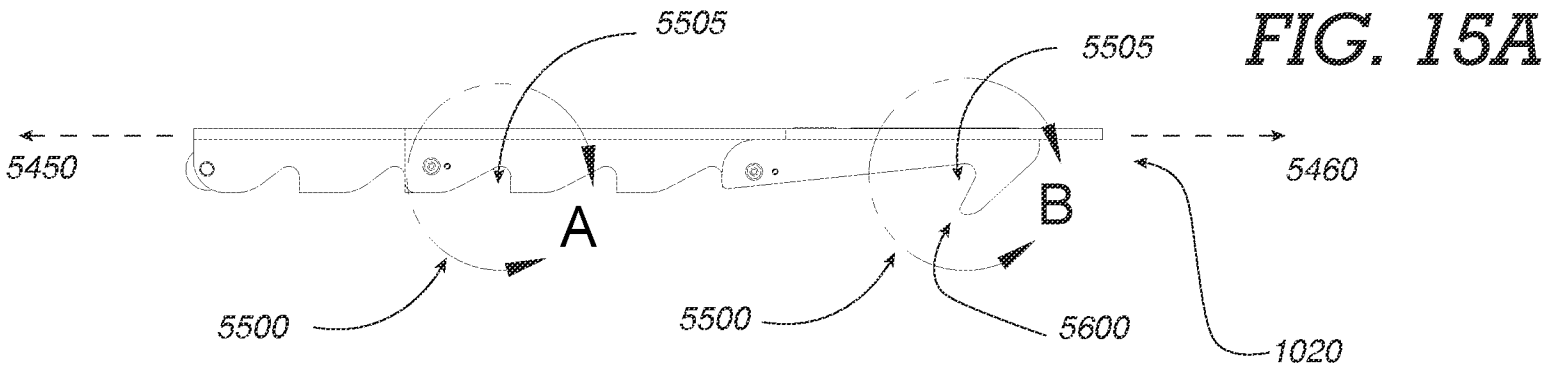
Figure 15C:
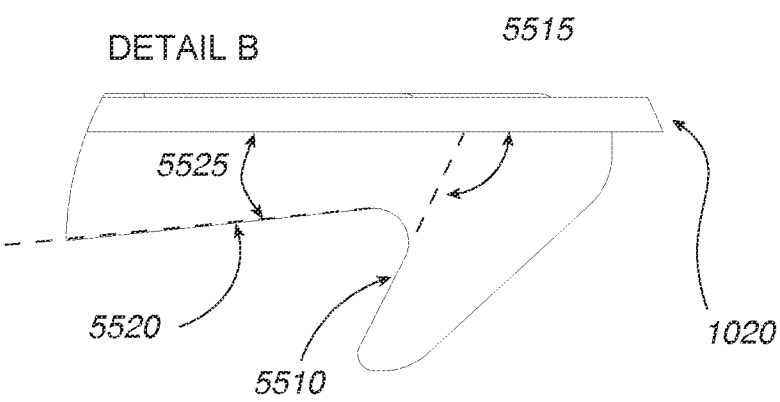
Figure 15B:
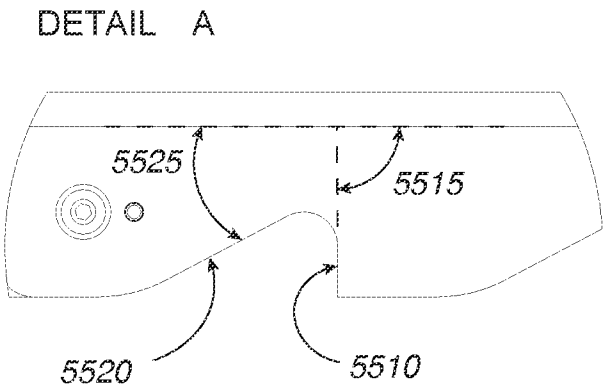

In certain embodiments, shown in FIG. 15A-FIG. 15B, a board comprises at least one directional arrest feature comprising a notch 5500 in the form of a hook 5600 proximal to a second end 1020 of the board, wherein the hook 5600 is configured to allow a rescuer to interconnect the second end 1020 of the board to a structure such as an edge of a pool or boat platform. This allows a single rescuer to tether a victim to the board, then hook the board to a structure—such as the edge of a pool or boat platform—allowing the rescuer to exit the water safely while leaving the victim unattended without risk of the victim overturning or submerging in the water. In certain embodiments, a first hook and second hook 5600 are interconnected with the second edges 5336 of the rails proximal to a second end 1020 of the board, and a second hook is interconnected with a second edge of a second rail proximal to the second end of the board. An open aspect 5610 of the hook is directed toward the second edges 5336 of the rails and in an inferior direction 5450, allowing the second end of the board to be interconnected with a structure. It will be appreciated that structures as discussed herein include, but are not limited to the edge of a pool, a boat platform, a dock, a hand-rail, or other structure capable of supporting a board with a victim tethered thereto.

Figure 16A:
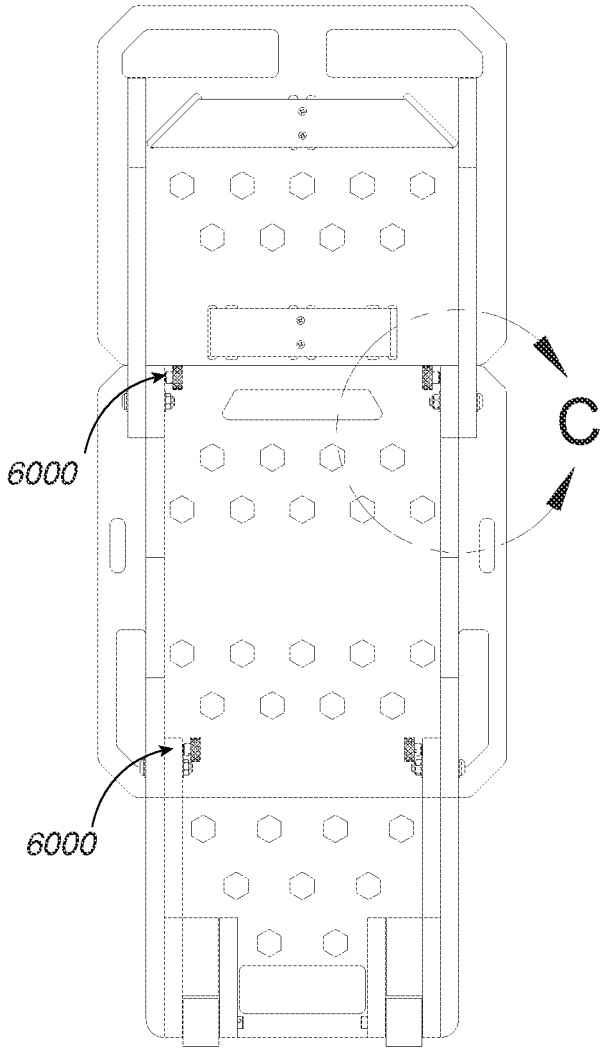
Figure 16B:
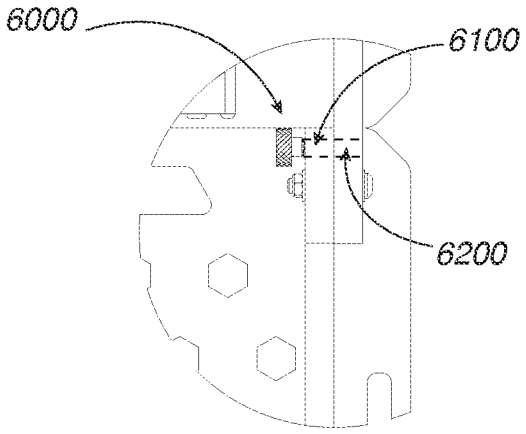

Certain embodiments, shown in FIG. 16A-FIG. 16B, comprise a folding board that further comprises pivot locks 6000 configured to prevent the pivotal rotation of a segment in relation to an adjacent segment. In certain embodiments, a pivot lock 6000 comprises a pin 6010 configured to extend through a first pivot lock aperture 6020 in a rail, and into a second pivot lock aperture 6020 in an adjacent rail, wherein the pivot lock apertures are colinear when the adjacent segments of the board are in an extended configuration 5100.

While various embodiments of the present invention have been described in detail, it is apparent that modifications and alterations of those embodiments will occur to those skilled in the art. However, it is to be expressly understood that such modifications and alterations are within the scope and spirit of the present invention. Further, the inventions described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. An apparatus for the extrication of a victim comprising:

a board comprising a first segment, and a second segment;

the first segment having a first roller and a second roller affixed proximally to a first end of the first segment, the rollers are disposed between a first end of a first rail and a first end of a second rail, the rails are affixed to a first side of the first segment, wherein the rails of the first segment each have a first edge directed toward the first side of the first segment, and the rails of the first segment are offset from each other;

the second segment having a first rail and a second rail affixed to a first side of the second segment, wherein the rails of the second segment each have a first edge directed toward the first side of the second segment, and the rails of the second segment are offset from each other;

a second end of the first rail of the first segment is pivotally interconnected with a first end of the first rail of the second segment;

a second end of the second rail of the first segment is pivotally interconnected with a first end of the second rail of the second segment;

wherein the first segment is pivotally rotatable to be disposed adjacent to a first side of the second segment in a folded configuration, wherein the first segment is pivotally rotatable to be disposed extended in an inferior direction away from the second segment in an extended configuration, and wherein the first rail of the second segment comprises a first directional arrest feature, the first directional arrest feature of the first rail of the second segment comprising a notch in the second edge of the first rail, and wherein the second rail of the second segment comprises a first directional arrest feature, the first directional arrest feature of the second rail of the second segment comprising a notch in the second edge of the second rail.

2. The apparatus of claim 1, wherein the first rail of the second segment comprises a directional arrest feature interconnected with a second edge of the first rail of the second segment, between the first end and the second end of the first rail of the second segment; and the second rail of the second segment comprises a directional arrest feature interconnected with a second edge of the second rail of the second segment, between the first end and the second end of the second rail of the second segment;

wherein the directional arrest features of the rails of the second segment allows the sliding of the board along the second edges of the rails of the second segment in a superior direction, and wherein the directional arrest features of the rails of the second segment impede the sliding of the board along the second edges of the rails of the second segment in an inferior direction.

3. The apparatus of claim 2, wherein the first rail of the first segment comprises a directional arrest feature interconnected with a second edge of the first rail of the first segment, between the first end and the second end of the first rail of the first segment; and the second rail of the first segment comprises a directional arrest feature interconnected with a second edge of the second rail of the first segment, between the first end and the second end of the second rail of the first segment;

wherein the directional arrest features of the rails of the first segment allows the sliding of the board along the second edges of the rails of the first segment in a superior direction, and wherein the directional arrest features of the rails of the first segment impede the sliding of the board along the second edges of the rails of the first segment in an inferior direction.

4. The apparatus of claim 1, wherein the notches of the rails of the first segment each comprise a superior aspect disposed 90-degrees or greater measured from the superior direction from the first side of the first segment;

the notches of the rails of the first segment each comprise an inferior aspect disposed less than 90-degrees measured from the inferior direction from the first side of the first segment;

the notches of the rails of the second segment each comprise a superior aspect disposed 90-degrees or greater measured from the superior direction from the first side of the second segment;

the notches of the rails of the second segment each comprise an inferior aspect disposed less than 90-degrees measured from the inferior direction from the first side of the first segment.

5. The apparatus of claim 1 further comprising a third segment;

the third segment having a first rail and a second rail affixed to a first side of the third segment wherein the rails of the third segment each have a first edge directed toward the first side of the third segment, and the rails of the third segment are offset from each other;

a second end of the first rail of the second segment is pivotally interconnected with a first end of the first rail of the third segment; and a second end of the second rail of the second segment is pivotally interconnected with a first end of the second rail of the third segment, wherein the third segment is pivotally rotatable to be disposed adjacent to a first side of the second segment in a folded configuration, and wherein the third segment is pivotally rotatable to be disposed extended in a superior direction away from the segment in an extended configuration.

6. The apparatus of claim 5, wherein the first rail of the second segment comprises a directional arrest feature interconnected with a second edge of the first rail of the second segment, between the first end and the second end of the first rail of the second segment; and the second rail of the second segment comprises a directional arrest feature interconnected with a second edge of the second rail of the second segment, between the first end and the second end of the second rail of the second segment;

wherein the directional arrest features of the rails of the second segment allows the sliding of the board along the second edges of the rails of the second segment in a superior direction, and wherein the directional arrest features of the rails of the second segment impede the sliding of the board along the second edges of the rails of the second segment in an inferior direction.

7. The apparatus of claim 6, wherein the first rail of the third segment comprises a directional arrest feature interconnected with a second edge of the first rail of the third segment, between the first end and the second end of the first rail of the third segment; and the second rail of the third segment comprises a directional arrest feature interconnected with a second edge of the second rail of the third segment, between the first end and the second end of the second rail of the third segment;

wherein the directional arrest features of the rails of the third segment allows the sliding of the board along the second edges of the rails of the third segment in a superior direction, and wherein the directional arrest features of the rails of the third segment impede the sliding of the board along the second edges of the rails of the third segment in an inferior direction.

8. The apparatus of claim 7, wherein the first rail of the first segment comprises a directional arrest feature interconnected with a second edge of the first rail of the first segment, between the first end and the second end of the first rail of the first segment; and the second rail of the first segment comprises a directional arrest feature interconnected with a second edge of the second rail of the first segment, between the first end and the second end of the second rail of the first segment;

wherein the directional arrest features of the rails of the first segment allows the sliding of the board along the second edges of the rails of the first segment in a superior direction, and wherein the directional arrest features of the rails of the first segment impede the sliding of the board along the second edges of the rails of the first segment in an inferior direction.

9. The apparatus of claim 8, wherein the directional arrest features of the rails of the first segment comprise notches in a second edge of the rails of the first segment;

the directional arrest features of the rails of the second segment comprise notches in a second edge of the rails of the second segment; and the directional arrest features of the rails of the third segment comprise notches in a second edge of the rails of the third segment.

10. The apparatus of claim 9, wherein the notches in the second edges of the rails of the third segment each comprise a hook having an open aspect directed toward an inferior direction and away from the first side of the third segment.

11. The apparatus of claim 10, wherein the notches of the rails of the first segment each comprise a superior aspect disposed 90-degrees or greater measured from the superior direction from the first side of the first segment;

the notches of the rails of the first segment each comprise an inferior aspect disposed less than 90-degrees measured from the inferior direction from the first side of the first segment;

the notches of the rails of the second segment each comprise a superior aspect disposed 90-degrees or greater measured from the superior direction from the first side of the second segment;

the notches of the rails of the second segment each comprise an inferior aspect disposed less than 90-degrees measured from the inferior direction from the first side of the first segment.

12. The apparatus of claim 11, further comprising a first pivot lock disposed between the first segment and the second segment; and a second pivot lock disposed between the second segment and the third segment, wherein the first pivot lock is configured to prevent pivotal rotation of the first segment in relation to the second segment when the first segment is in the extended configuration, and wherein the second pivot lock is configured to prevent pivotal rotation of the third segment in relation to the second segment when the third segment is in the extended configuration.

13. An apparatus for the stabilizing of a victim comprising:

a board;

a first rail and a second rail interconnected with the first side of the board;

the rails extend from proximal to the first end of the board toward a second end of the board;

the first rail comprises a first edge directed toward the first side of the board, the second rail comprises a first edge directed toward the first side of the board, and the second rail is laterally offset from the first rail;

the first rail comprises a second edge directed away from the first side of the board, and the second rail comprises a second edge directed away from the first side of the board;

the first rail comprises a first directional arrest feature interconnected with the second edge of the first rail; and the second rail comprises a first directional arrest feature interconnected with the second edge of the second rail;

wherein the first directional arrest features allow the sliding of the board along the second edges of the rails in a superior direction, wherein the first directional arrest features impede the sliding of the board along the second edges of the rails in an inferior direction, and wherein the first directional arrest feature of the first rail comprises a notch in the second edge of the first rail and the first directional arrest feature of the second rail comprises a notch in the second edge of the second rail.

14. The apparatus of claim 13, further comprising a first roller and a second roller affixed proximal to a first end of the board, the rollers disposed between the first rail and the second rail.

15. The apparatus of claim 13, wherein the notches each comprise a hook having an open aspect directed in the inferior direction and away from the first side of the board.

16. The apparatus of claim 13, wherein a superior aspect of each notch is disposed at a first angle of 90-degrees or greater from the first side of the board from the superior direction; and an inferior aspect of each notch is disposed at a second angle of less than 90-degrees from the first side of the board from the inferior direction.

17. The apparatus of claim 14, wherein the first rail comprises a plurality of directional arrest features, and the second rail comprises a plurality of directional arrest features, wherein the plurality of directional arrest features of the second rail match the plurality of directional arrest features of the first rail in quantity, wherein the plurality of directional arrest features of the second rail are laterally opposite the plurality of directional arrest features of the first rail, wherein the plurality of directional arrest features allow the sliding of the board along the second edges of the rails in a superior direction, and wherein the plurality of directional arrest features impede the sliding of the board along the second edges of the rails in an inferior direction.

18. The apparatus of claim 17, wherein the plurality of directional arrest features of the first rail comprise at least one hook having an open aspect directed in the inferior direction and away from the first side of the board;

the plurality of directional arrest features of the first rail comprise at least one notch having a superior aspect disposed at a first angle of 90-degrees or greater from the first side of the board from the superior direction and an inferior aspect disposed at a second angle of less than 90-degrees from the first side of the board from the inferior direction;

the plurality of directional arrest features of the second rail comprise at least one hook having an open aspect directed in the inferior direction and away from the first side of the board; and the plurality of directional arrest features of the second rail comprise at least one notch having a superior aspect disposed at a first angle of 90-degrees or greater from the first side of the board from the superior direction and an inferior aspect of the at least one notch disposed at a second angle of less than 90-degrees from the first side of the board from the inferior direction.

* * * * *